US006661377B2

(12) United States Patent
Lee et al.

(10) Patent No.: US 6,661,377 B2
(45) Date of Patent: Dec. 9, 2003

(54) PHASED ARRAY ANTENNA USING GAIN SWITCHED MULTIMODE FABRY-PEROT LASER DIODE AND HIGH-DISPERSION-FIBER

(75) Inventors: Yong-Tak Lee, Kwangju (KR); Jung Hye Chae, Kwangju (KR)

(73) Assignee: Kwangju Institute of Science and Technology, Kwangju (KR)

( * ) Notice: Subject to any disclaimer, the term of this patent is extended or adjusted under 35 U.S.C. 154(b) by 0 days.

(21) Appl. No.: 10/082,319

(22) Filed: Feb. 26, 2002

(65) Prior Publication Data

US 2003/0080899 A1 May 1, 2003

(30) Foreign Application Priority Data

Oct. 30, 2001 (KR) ..... 2001-67184

(51) Int. Cl.[7] ..... H01Q 3/22
(52) U.S. Cl. ..... 342/375
(58) Field of Search ..... 342/368, 375

(56) References Cited

U.S. PATENT DOCUMENTS

H1625 H * 1/1997 Frankel ..... 342/375
5,977,911 A * 11/1999 Green et al. ..... 342/375
6,114,994 A * 9/2000 Soref et al. ..... 342/375
6,337,660 B1 * 1/2002 Esman et al. ..... 342/375

OTHER PUBLICATIONS

Use of direct–modulated/gain–switched optical links in monopulse–type active phased array systems, S.T. Chew et al., IEEE Transactions on Microwave Theory and Techniques, vol. 44(2), p. 326–330, Feb. 1996.*

* cited by examiner

*Primary Examiner*—Thomas H. Tarcza
*Assistant Examiner*—Fred H Mull
(74) *Attorney, Agent, or Firm*—Greenblum & Bernstein, P.L.C.

(57) ABSTRACT

The present invention is about phased array antenna using gain switched multimode Fabry-Perot laser diode (FP-LD) and high-dispersion fiber. More particularly, the invention deals with techniques that allow compact and low-cost system implementation for phased array antenna adopting optical control and also allows continuous time delay for each antenna in the array to induce phase difference.

5 Claims, 8 Drawing Sheets

PHASED ARRAY ANTENNA USING GAIN SWITCHED MULTIMODE FABRY-PEROT LASER DIODE AND HIGH-DISPERSION-FIBER

BACKGROUND OF THE INVENTION

1. Field of the Invention

The present invention is about phased array antenna using gain switched multimode Fabry-Perot laser diode (FP-LD) and high-dispersion-fiber. Especially, the invention deals with the techniques that allow compact and low-cost system implementation for phased array antenna by adopting optical control and also allowing continuous time delay for each antenna in the array to induce phase difference.

2. Description of the Related Technology

Electrically controllable phased array antenna is attracting great attention in applications such as microwave communication and radar systems. However, practical implementations are very limited, because true time delay system to induce phase difference between antennas is too complicated.

On the other hand, since optical phased array antenna uses fiber based optical systems it has many advantages such as ability to induce time delay easily, immunity to electromagnetic interference (EMI), efficiency of bandwidth usage, and capability to produce light and compact systems.

FIG. 1 is a conventional phased array antenna structure diagram, which uses optical fiber grating as time delay line and compose of wavelength tunable laser (100), external modulator (110), 3 dB coupler (120*a*, 120*b*, 120*c*, 120*d*), optical fiber grating (130*a*, 130*b*, 130*c*, 130*d*), photodetector (140*a*, 140*b*, 140*c*, 140*d*), amplifier (150*a*, 150*b*, 150*c*, 150*d*), and antenna (160*a*, 160*b*, 160*c*, 160*d*).

In FIG. 1, optical power from wavelength tunable laser (100) is modulated by external modulator (110) which utilizes the electro-optics effect caused by RF (radio frequency) signals that are transferred to the antenna. The modulated power is then inputted to delay line of optical fiber grating (130*a*, 130*b*, 130*c*, 130*d*) through 3 dB coupler (120*a*, 120*b*, 120*c*, 120*d*).

Here, wavelength dependent time delay occurs due to the different reflection time for different laser wavelength. The light signal is then inputted to photodetector (140*a*, 140*b*, 140*c*, 140*d*) through 3 dB coupler (120*a*, 120*b*, 120*c*, 120*d*), where it is converted photo-electrically (optic-to-electric: O/E) into RF signal, and inputted into each elements of the antenna (160*a*, 160*b*, 160*c*, 160*d*).

However, the amount of time delay in the above configuration is dependent on the spacing of fiber grating. The advantage that this kind of methods for using optical fiber grating is it requires only a single light source and short length of optical fiber. However, it has the disadvantage that beam position of phased array antenna not being continuous.

FIG. 2 is a conventional phased array antenna, which uses high-dispersion-optical fiber and compose of wavelength tunable laser (200*a*, 200*b*, 200*c*, 200*d*), external modulator (210*a*, 210*b*, 210*c*, 210*d*), photodetector (220*a*, 220*b*, 220*c*, 220*d*), amplifier (230*a*, 230*b*, 230*c*, 230*d*), antenna (240*a*, 240*b*, 240*c*, 240*d*), laser control signal (250*a*, 250*b*, 250*c*, 250*d*), micro-signal source (260*a*, 260*b*, 260*c*, 260*d*), and high-dispersion fiber (270*a*, 270*b*, 270*c*, 270*d*).

In FIG. 2 system utilizes the phenomenal fact that optical fiber has wavelength dependent dispersion property. In this system, optical power of wavelength tunable laser (200*a*, 200*b*, 200*c*, 200*d*) is modulated by external modulator (210*a*, 210*b*, 210*c*, 210*d*) using RF signal, where it passes through high-dispersion fiber (270*a*, 270*b*, 270*c*, 270*d*), and then phase shifted RF signal is obtained through the photodetector (220*a*, 220*b*, 220*c*, 220*d*).

The time delay obtained in the above system is dependent on the amount of dispersion of the fiber, length of the fiber, and wavelength difference of the wavelength tunable laser. Therefore, in this case, since a multiplicity of wavelength tunable lasers and external modulators are required, it was difficult to implement systems at low cost.

FIG. 3 is a conventional dispersive and non-dispersive optical fiber based phased array antenna with a single light source and a single modulator. The system of this figure compose of wavelength tunable laser (300), external modulator (310), laser control signal (320), 1XN power splitter (330), dispersive fiber (340), non-dispersive fiber (350), photodetector (360), amplifier (370), and antenna (380).

In FIG. 3, instead of using a multiplicity of light sources and modulators as in FIG. 2, optical power is distributed by 1×N power splitter (330), and time delay is achieved by adjusting the lengths of dispersive fiber and non-dispersive fiber in the high-dispersion fiber portion. To make use of this method in implementation on practical systems, an additional temperature stabilizing system is required, because time delay difference arises due to different temperature property between dispersive fiber (340) and non-dispersive fiber (350).

FIG. 4 shows method for using conventional chirped fiber grating (CFG) which compose of pattern controller (400), wavelength tunable laser (410*a*, 410*b*, . . . , 410*n*), optical multiplexer (420), external modulator (430), circulator (440), CFG (450), wavelength demultiplexer (460), photodetector (470*a*, 470*b*, . . . , 470*n*), amplifier (480*a*, 480*b*, . . . , 480*n*), and antenna (490*a*, 490*b*, . . . , 490*n*).

This system uses the phenomenal fact that the reflection position in CFG (450) is dependent on the selected chirping rule. Here, RF signal modulates the output power from wavelength tunable laser (410*a*, 410*b*, . . . , 410*n*) at the external modulator (430), and the modulated signal is inputted to the circulator (440).

Output signal from the circulator (440) is reflected in the chirped fiber grating that is configured according to the wavelength, so that it has a time delay corresponding to the grating spacing. It again passes through the circulator (440) and then into photodetector (470*a*, 470*b*, . . . , 470*n*), and finally output as phase shifted RF signal. In time delay path using CFG (450), since the grating spacing varies linearly, change in time delay can also be adjusted continuously. However, this method requires wavelength stability and linearity of CFG (450) as well as a multiplicity of light sources.

Since the method from FIG. 4 requires a shorter length of fiber for time delay compare to that of FIG. 3, it does not need an additional temperature stabilizing system as in FIG. 3. However, because adequate CFG's are not commercially available, there is a practical limitation in implementing this type of method.

As mentioned hitherto, phased array antenna system utilizing time delay by fiber grating, CFG, or dispersive fiber in the prior art requires essentially a multiplicity of wavelength tunable lasers and external modulators. In the case of FIG. 3, although it uses a single light source and a single external modulator, it requires a microwave source to modulate over the microwave band, over which the antenna operates. Hence, the overall system was difficult to build at a low cost.

Therefore, it is necessary to provide a simple and low-cost system for phased array antenna over the microwave band, applicable in the practical wave environment.

SUMMARY OF THE INVENTION

The main objective of the present invention is to resolve the aforementioned problems and, therefore, to provide an accurate low-cost phase array antenna system, which does not need costly external modulator and microwave signal source as in the prior art. Such system is available in the present invention by electrically controlling the phase of phased array antenna, while utilizing the features of optical system using the same method of optically controllable phased array antenna as in the prior art.

To achieve the aforementioned objective, the present invention is to provide a time delay characterized phased array antenna by first generating optical pulses by gain switching of multimode Fabry-Perot laser diode(FP-LD), and making them into optical pulse train with varied wavelengths using mode separation by high-dispersion fiber, then distributing the signal by power splitter, and passing it through each fiber of different lengths to cause time delay.

The above and other features and advantages of the present invention will be more clearly understood for those skilled in the art from the following detailed description taken in conjunction with the accompanying drawings, which form parts of this disclosure.

DETAILED DESCRIPTION OF THE EMBODIMENT

Hereinafter, configuration and operation of the practical application for present invention will be described thoroughly with the reference of the accompanying figures.

Figure 5:
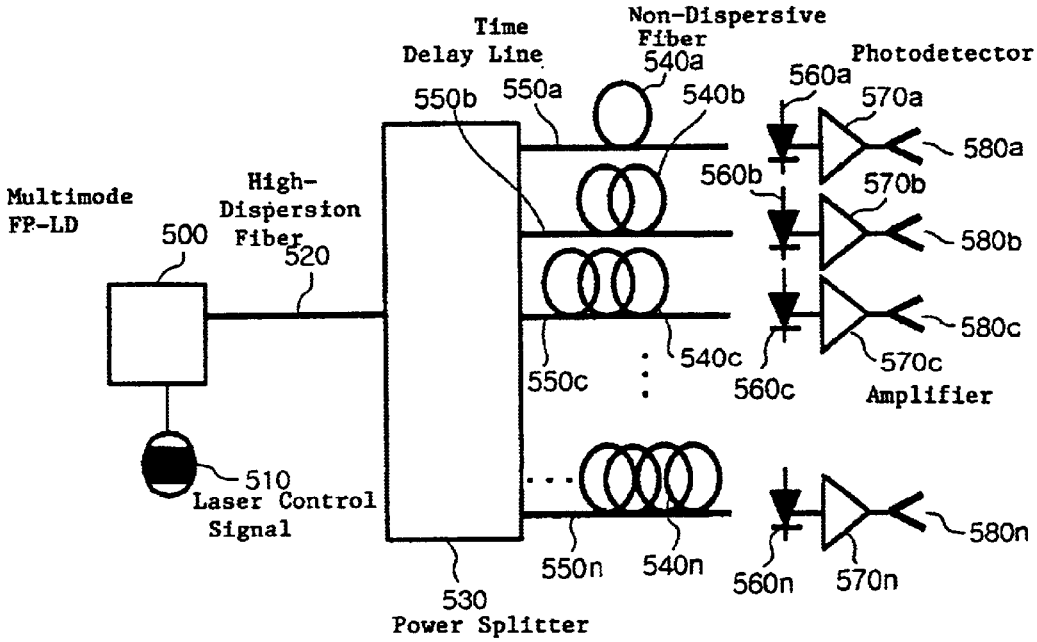
FIG. 5 is a configuration diagram of phased array antenna using gain switched multimode Fabry-Perot laser diode (FP-LD) and high-dispersion fiber according to the present invention.

FIG. 5 is a configuration diagram of phased array antenna using gain switched multimode Fabry-Perot laser diode (FP-LD) and high-dispersion fiber according to the present invention.

As shown in FIG. 5, the system consist of the following; multimode FP-LD (500) to generate optical pulses by g in switching, laser control signal (510); high-dispersion fiber (520) to pass the optical pulse generated in the previous step and to generate microwave signal by separating modes of the multimode FP-LD (500); power splitter (530) to distribute the optical signal into the number of arrayed antennas to send the mode separated optical pulse train to the antenna array; time delay lines (550*a*, 550*b*, 550*c*, . . . , 550*n*) to induce phase difference due to different time delay by passing the distributed optical pulses through non-dispersive fiber (540*a*, 540*b*, 540*c*, . . . , 540*n*) having different lengths respectively; photodetectors (560*a*, 560*b*, 560*c* . . . , 560*n*) to photo-electrically convert the optical pulses having the phase difference; amplifier (570*a*, 570*b*, 570*c*, . . . , 570*n*) to amplify the photo-electrically converted optical pulses; and antenna array (580*a*, 580*b*, 580*c*, . . . , 580*n*) to transmit the amplified pulses.

Here, if phase difference is to be eliminated in the array, in other words, to position the antenna beam at the center of the array, each delay time for time delay lines (550*a*, 550*b*, 550*c*, . . . , 550*n*) in the array should be made to correspond to gain switching frequency. And also, in order to control the direction of output beam of the array antenna which is same as controlling phase difference between array antennas, gain switching frequency is used.

Figure 1:
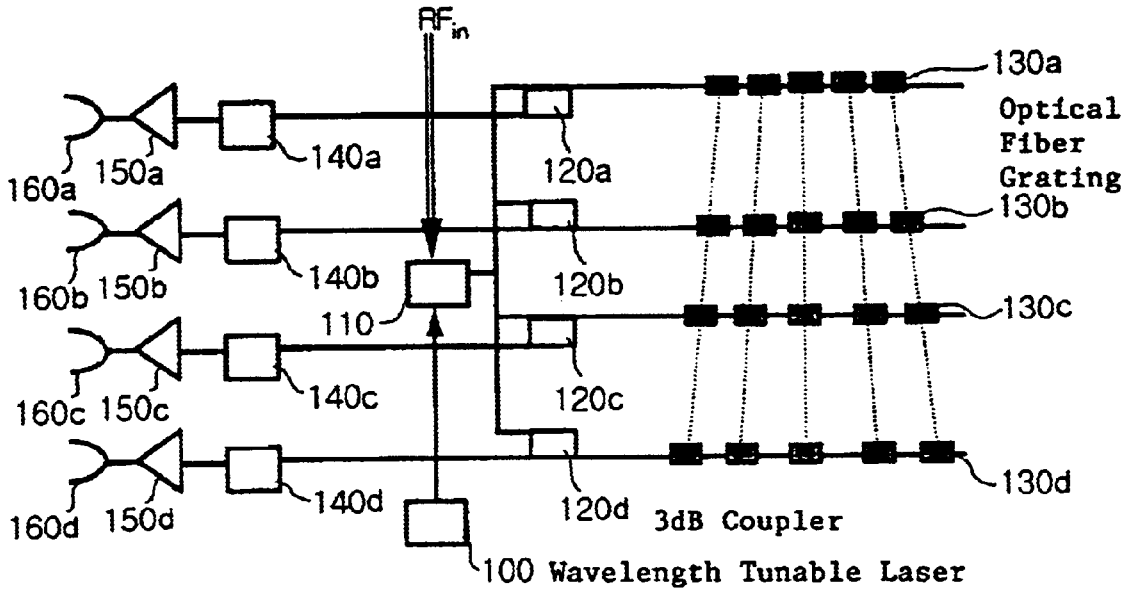
Fig. 1 Prior Art
FIG. 1 is a configuration diagram of conventional phased array antenna using optical fiber grating.
Figure 2:
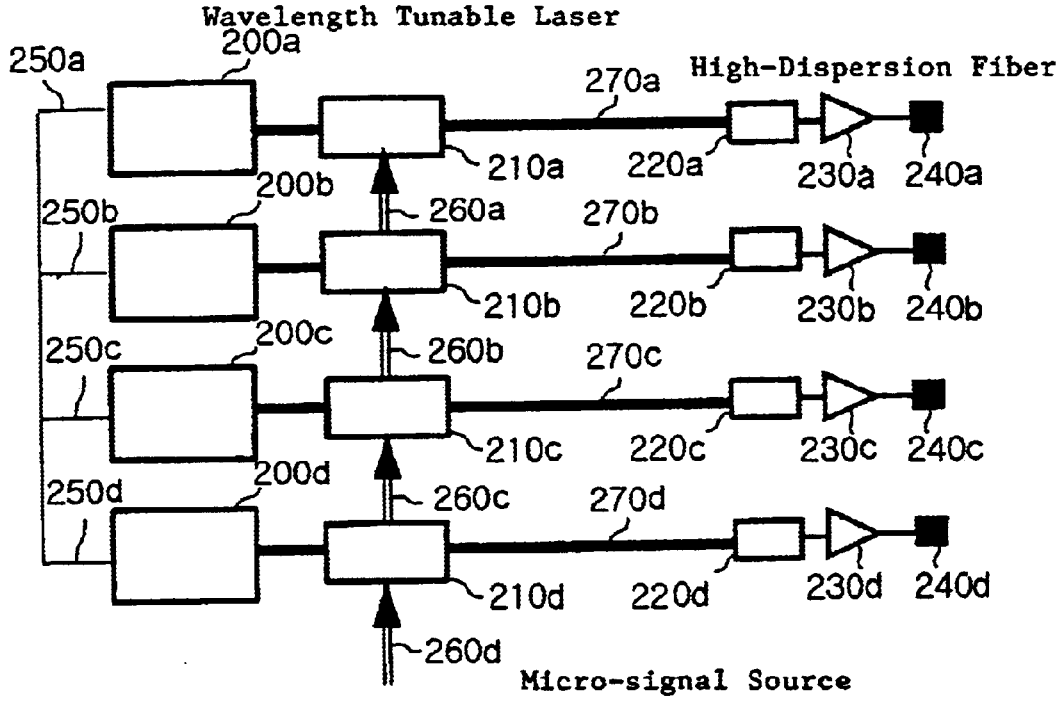
Fig. 2 Prior Art
FIG. 2 is a configuration diagram of conventional phased array antenna using high-dispersion optical fiber.
Figure 3:
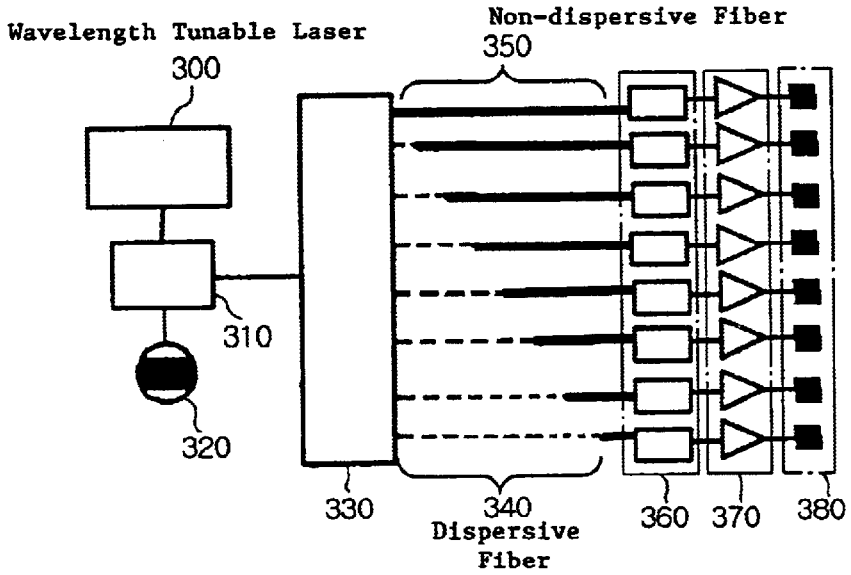
Fig. 3 Prior Art
FIG. 3 is a configuration diagram of conventional phased array antenna using dipersive and non-dispersive fiber with a single light source and a single modulator.
Figure 4:
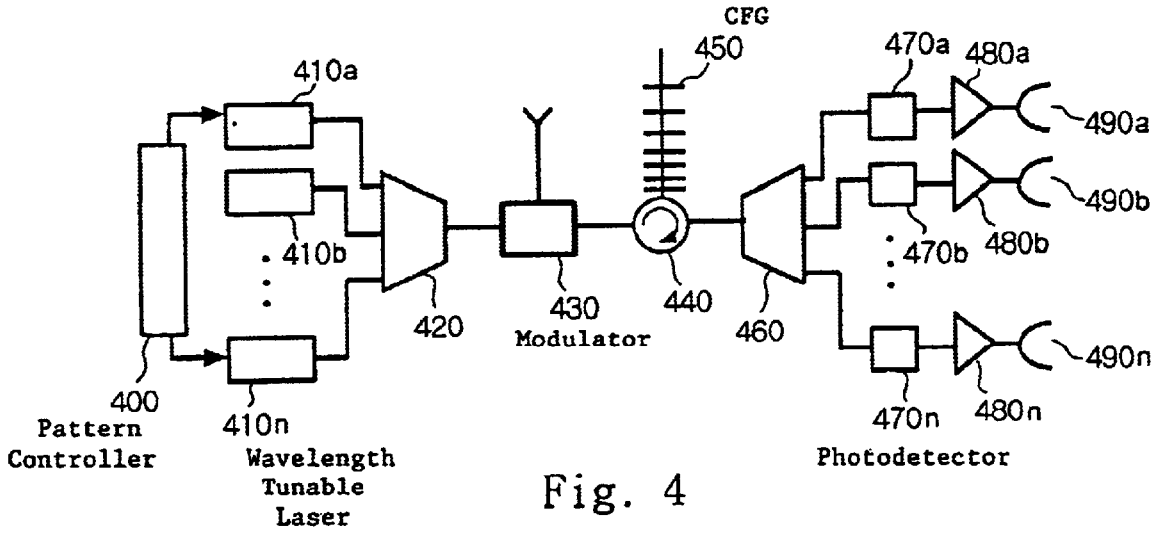
Fig. 4 Prior Art
FIG. 4 is a configuration diagram of conventional phased array antenna using chirped fiber grating.

FIG. 5 uses the same delay time method as in FIG. 4 but by replacing the wavelength tunable laser and optical modulator in FIG. 4, which is used for generating wave signal that antenna transmits, with multimode FP-LD implementation of low cost and compact system is possible.

Figure 6:
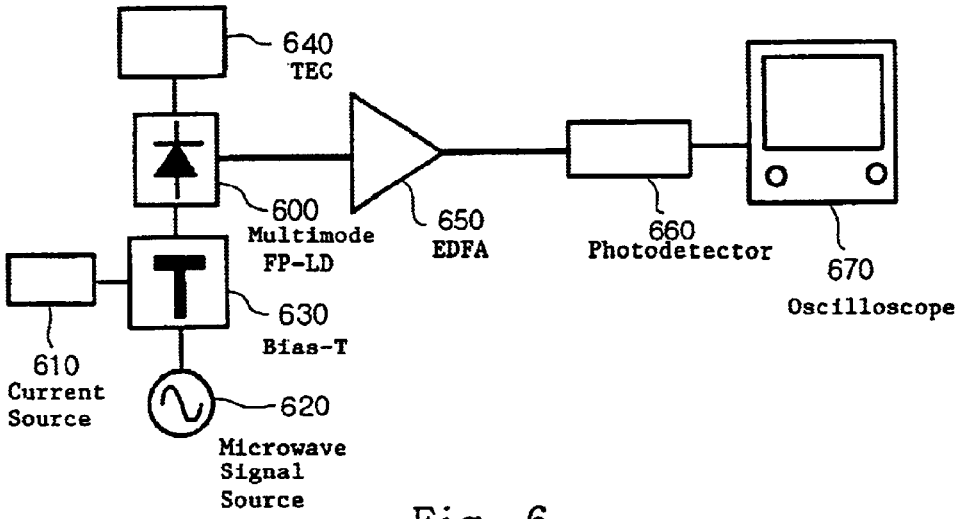
FIG. 6 is a configuration diagram of gain switching of multimode FP-LD.

Here, gain switched multimode FP-LD (600) is shown in FIG. 6.

The gain switching system in FIG. 6 consist with current source (610), microwave signal source (620), bias-T (630), thermoelectric cooler (TEC) (640), erbium doped fiber amplifier (EDFA) (650), photodetector (660), and oscilloscope (670).

Not only can semiconductor laser provide light source having the wavelength band of 0.7~1.6 $\mu$m depending on selected gain material, but also, in case of multimode FP-LD (600), provide spacing adjustment by adjusting resonance length of laser.

Therefore, it provides the light source to cover almost all the aforementioned bandwidth. And, gain switching multimode FP-LD (600) generates optical pulses duration of 20~30 ps. Gain switching is achieved by adequately adjusting injection current in order to output only the first pulse of relaxation oscillation generated at the initial stage of semiconductor laser's operation.

As shown in FIG. 6, if bias from current source (610) is injected to multimode FP-LD (600) with a level just below the threshold current along with signal from microwave source (620), pulse width can vary according to the bias level and the amplitude of sine wave. Therefore, the optimal condition for bias level and injected sine wave amplitude for a minimum pulse width can be determined by adjusting these parameters adequately. The resulting optical pulse is then amplified by erbium doped fiber amplifier (EDFA) (650).

The amplified optical power pulse at this stage is passed trough high-dispersion fiber (520), where mode seperation of each mode of multimode FP-LD (500) is obtained. At this stage, it is necessary to use high-dispersion fiber (520) with large value of negative dispersion over the applied wavelength.

In order to offset red shifted frequency chirping that gain switched semiconductor laser has, high-dispersion fiber with negative value of dispersion is used. With the use of this fiber, mode separation over time as well as pulse compression is obtained. If fiber with a large positive dispersion is used, pulse spreading occurs along with mode separation, which will make mode separation not so clear. For example, in case of measuring chromatic dispersion around wavelength of 1.55 μm, dispersion compensating fiber (DCF) is used as high-dispersion fiber (520).

The role of the high-dispersion fiber (520) is to generate microwave for antenna transmission, so by adjusting the length of the high-dispersion fiber (520) desired microwave signal can be obtained. Therefore, the length of the high-dispersion fiber is selected according to the frequency that is transmitted from the antenna.

Figure 7:
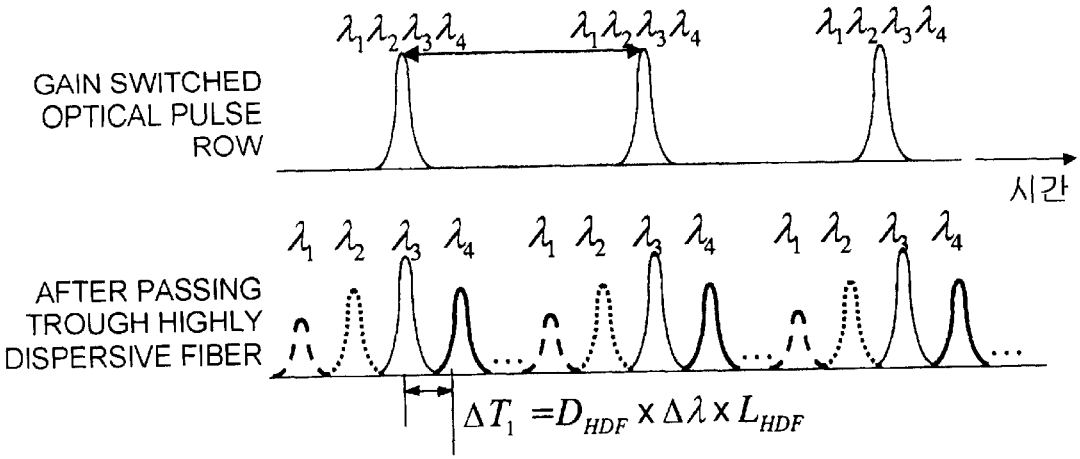
FIG. 7 depicts gain switched optical pulse train and mode separated multimode optical pulse train that has passed trough high-dispersion fiber.

FIG. 7 is a diagram representing the process of generating multimode optical pulse train over time domain.

In FIG. 7, DHDF represents chromatic dispersion of high-dispersion fiber, LHDF represents length of high-dispersion fiber, and Δλ represents mode spacing of multimode FP-LD, respectively.

Figure 8:
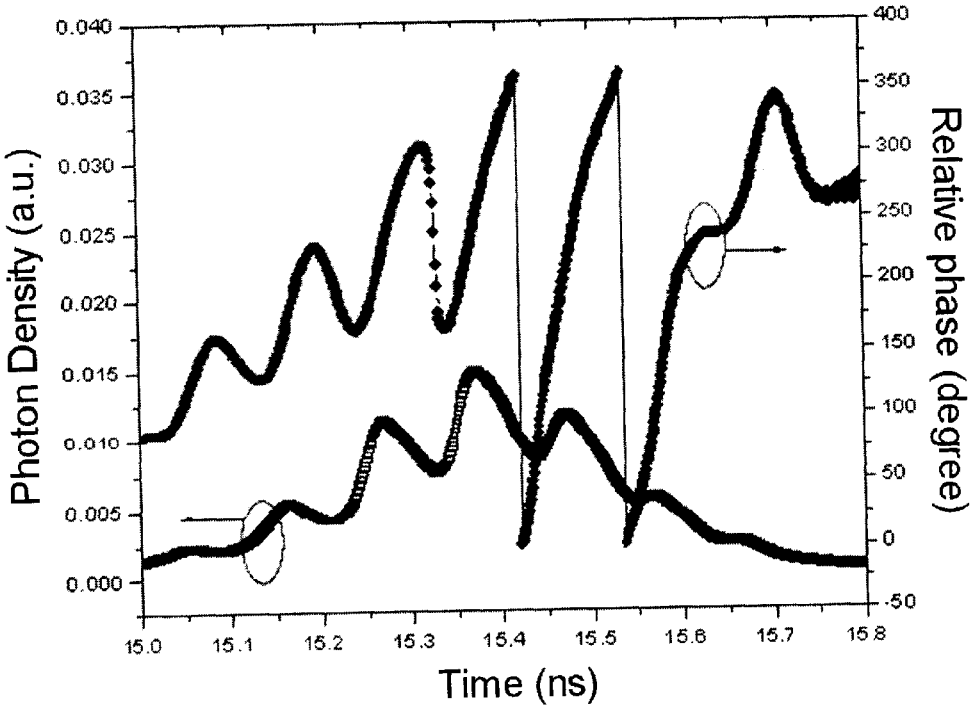
FIG. 8 is a graph showing optical intensity and phase shift of multimode optical pulse train.

FIG. 8 shows optical intensity and phase shift of multimode optical pulse train generated by the aforementioned method, where mode spacing of FP-LD is 1.1 nm, center frequency is 1.55 μm, and 1 km long DCF having chromatic dispersion of −95 ps/nm/km at 1.55 μm is used as high-dispersion fiber.

Optical pulse train of each wavelength separated by the high-dispersion fiber (520) shown in FIG. 5 is distributed by power splitter (530), and then is passed through non-dispersive fiber (540*a*, 540*b*, 540*c*, . . . , 540*n*) to generate time delay by optical delay lines causing phase difference between antennas.

Here, delay time inducing non-dispersive fiber(540*a*, 540*b*, 540*c*, . . . , 540*n*) should bring about time delay without affecting mode separation. Therefore, fiber having almost no dispersion should be used. For example, dispersion shifted fiber (DSF) is adequate for the case of light source with wavelength of 1.55 μm.

Figure 9:
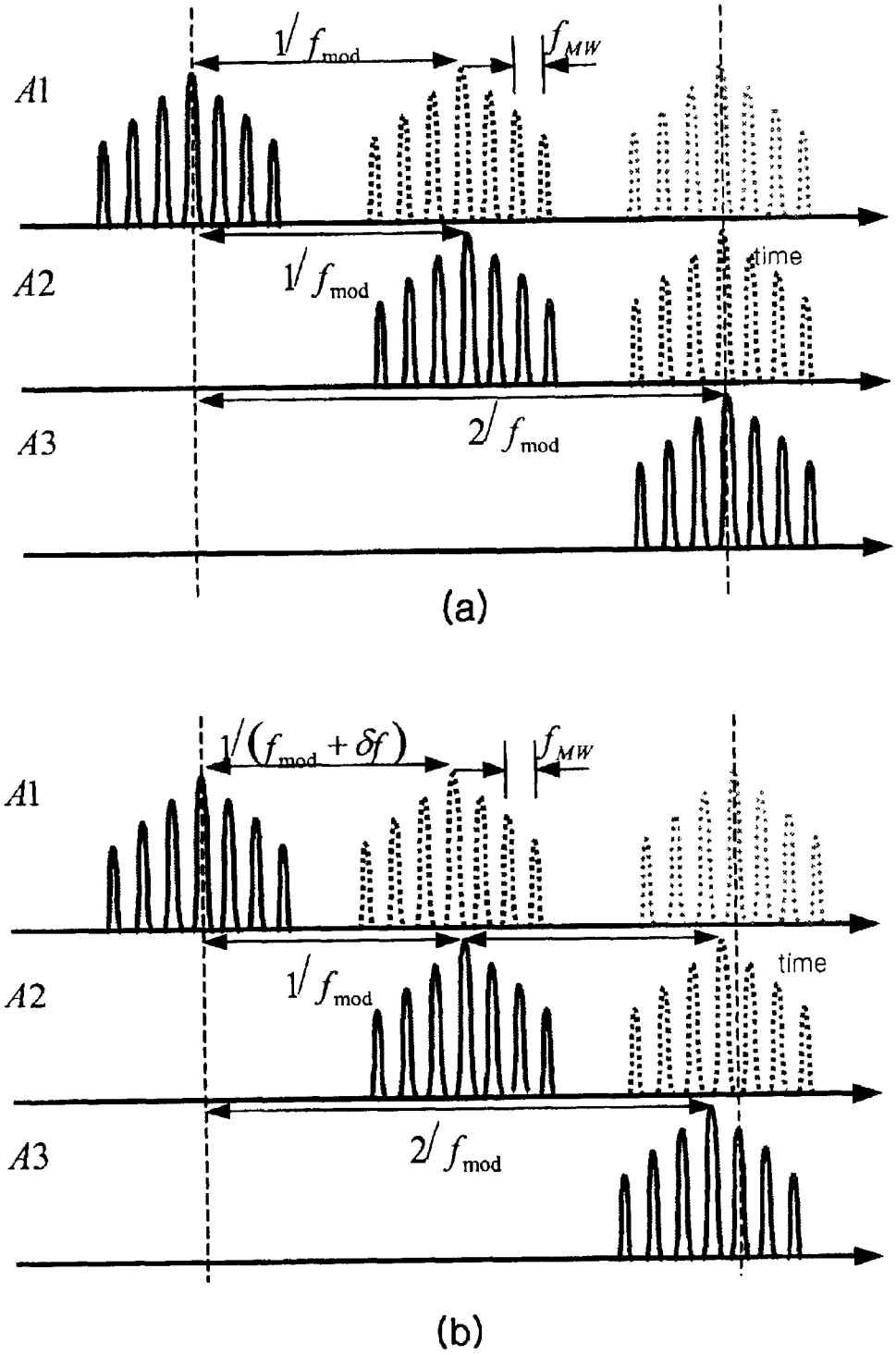
FIGS. 9*a* and 9*b* are pictures representing relative phase shift at each antenna due to gain switched frequency adjustment.

Time delay induced phase difference that enter the photodetector (560*a*, 560*b*, 560*c*, . . . , 560*n*) which is connected to each antenna, is determined by the length of non-dispersive fiber (540*a*, 540*b*, 540*c*, . . . , 540*n*). The time delay here is given by the amount corresponding to repetition rate of gain switching as shown in FIG. 9*a*. Thus with fixed time delay, the phase in the entire array is all the same at the above gain switching frequency.

As shown in FIG. 9*b*, phase shift is achieved by adjusting the gain switching frequency. In other words, if frequency of signal source is offset from the aforementioned initial gain switching frequency, since each length of non-dispersive fiber (540*a*, 540*b*, 540*c*, . . . , 540*n*) in the array is set for the previous gain switching frequency, phase is shifted as in FIG. 9*b*.

Figure 10:
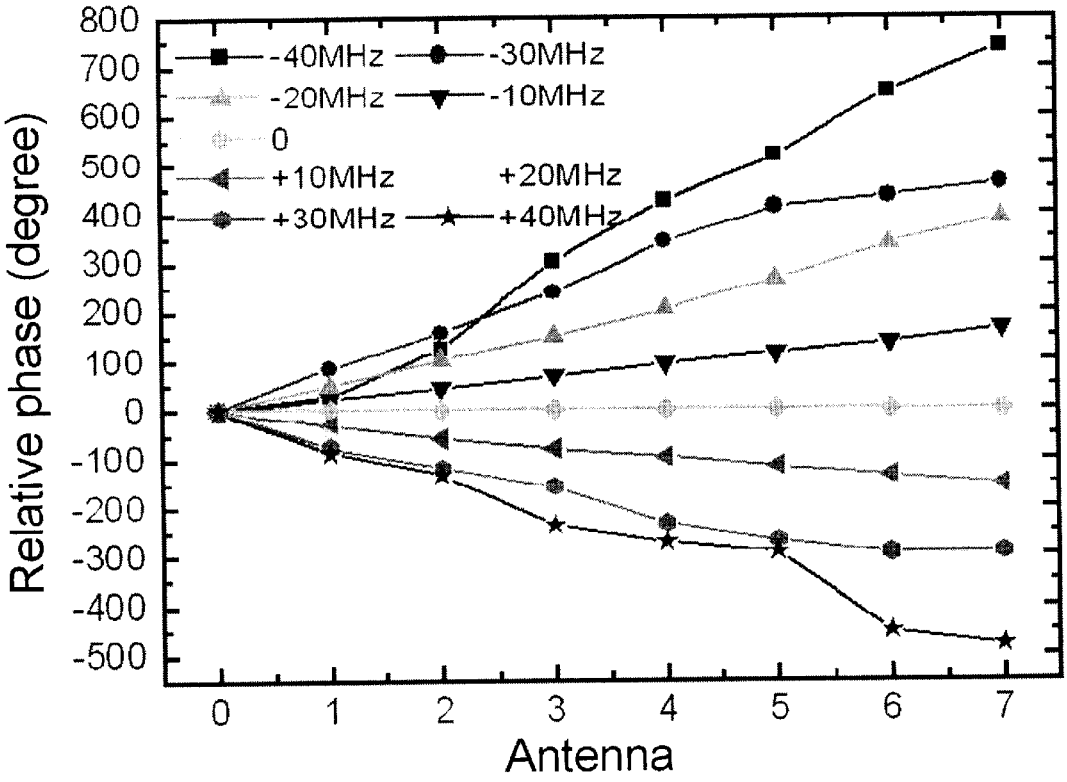
FIG. 10 is a graph showing relative phase shift of antennas due to gain switched frequency adjustment.

FIG. 10 shows the phase difference in each array generated according to the gain switching frequency as described above.

Figure 11:
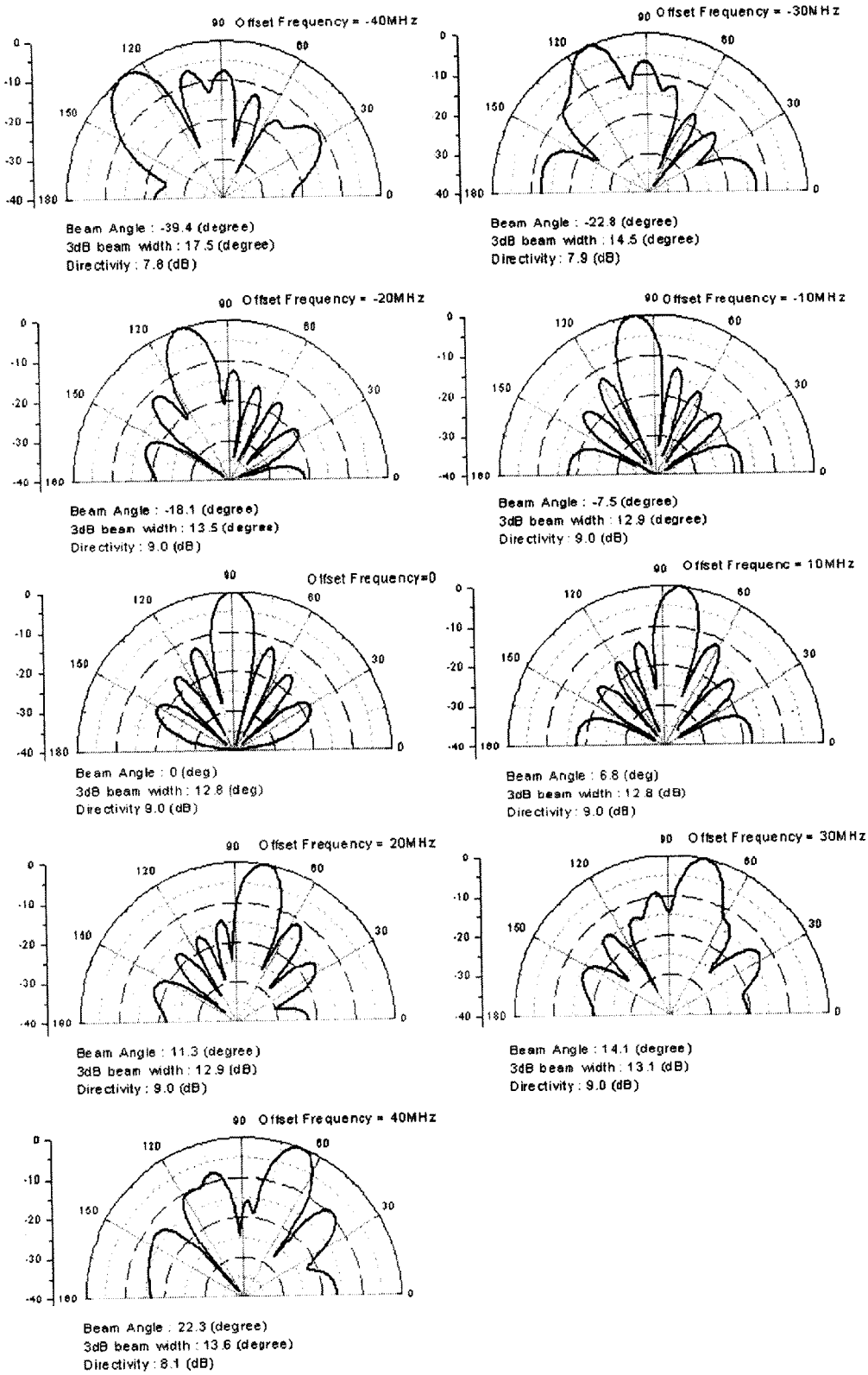
FIG. 11 shows graphs of various forms representing embodiments of beam patterns of phased array antenna due to phase difference in an actual antenna array.

FIG. 11 shows practical example of various beam patterns of actual phased array antenna generated by phase difference as described above.

In this embodiment, spacing between antennas is 1.5 cm and the phase shift generated in 10 GHz microwave signal by gain switching frequency shift offset, using the 1 km long high-dispersion fiber as in the previous embodiment, has changed direction of the beam patterns in actual phased array antenna.

Figure 12:
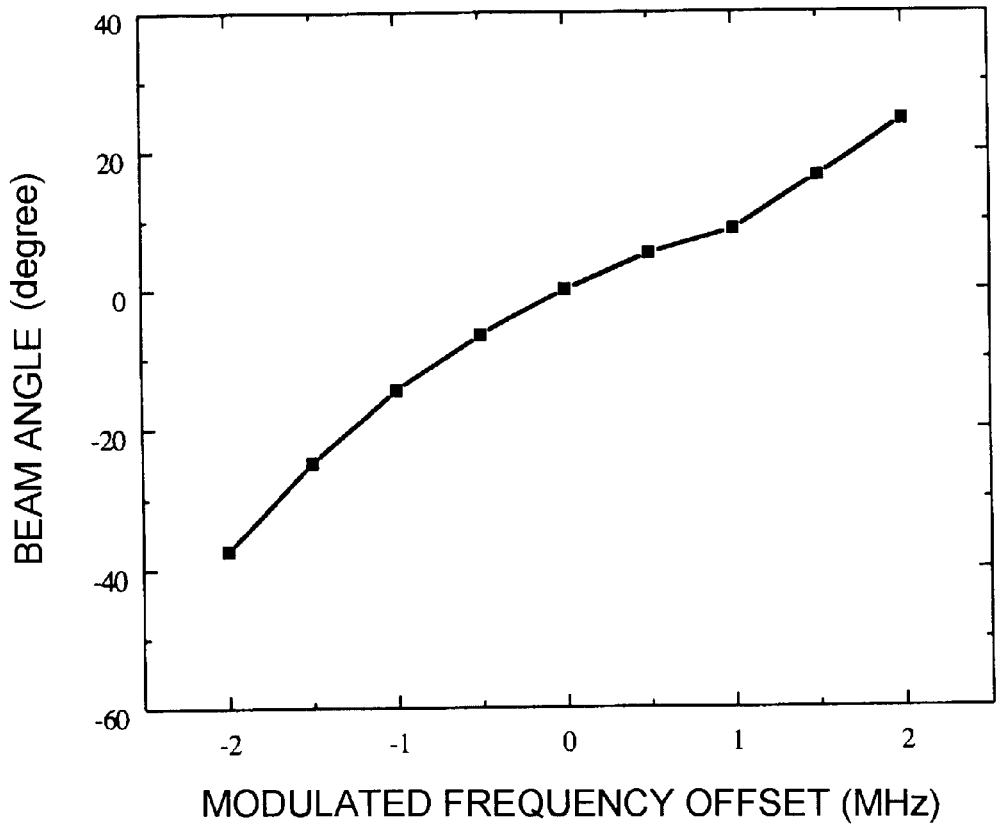
FIG. 12 is a graph representing change of beam direction according to modulated frequency change for gain switching.

FIG. 12 is a graph representing change of beam direction according to the modulated frequency change for gain switching.

As described above, phased array antenna using gain switched multimode FP-LD and high-dispersion fiber according to the present invention has the following advantageous features.

First, a low-cost system can be achieved, since it uses gain switched multimode FP-LD and highly dispersive fiber instead of using wavelength tunable laser and optical modulator of conventional phased array antenna system.

Second, due to the continuous phase variation continuous beam adjustment is available in contrast to the conventional optical fiber grating case.

Third, generation of very stable microwave signal is possible, since mode separation after passing the gain switched FP-LD, signal through high-dispersion fiber is dependent only on dispersion property of the fiber.

Fourth, phase shifting is very rapid comparing with the case of loading microwave directly on external modulator of the prior art, since the present invention uses optical pulse train in phase adjustment by gain switching frequency as in FIG. 8. Therefore, the tunable range of gain switching frequency is very narrow for phase shifting. In other word, phase shift in the antenna is relatively large for very small frequency change.

Although the present invention has been described and illustrated in connection with the specific embodiments, it will be apparent for those skilled in the art that various modifications and changes may be made without departing from the idea of the present invention set forth in this disclosure.

What is claimed is:

1. A phased array antenna comprising;

a multimode Fabry-Perot laser diode that generates optical pulses by gain switching, a high-dispersion fiber which carries said optical pulses and which generates a microwave signal by separating each mode of said multimode Fabry-Perot laser diode, a power splitter that distributes said mode-separated optical pulse train into a number of antennas in the array to send the pulse signal to the antenna array, a time delay line which causes a phase difference for different time delays respectively by passing said distributed optical pulses through different lengths of non-dispersive fiber respectively, a photodetector which photo-electrically converts said optical pulses having the phase difference, an amplifier that amplifies said photo-electrically converted pulses, and an antenna array that transmits said amplified pulses.

2. The phased array antenna of claim 1, wherein a frequency of said microwave signal is tuned by adjusting a length of said high-dispersion fiber and resonance mode spacing of said multimode Fabry-Perot laser diode.

3. The phased array antenna of claim 1, wherein said multimode Fabry-Perot laser diode is used as a light source to generate a microwave signal.

4. The phased array antenna of claim 1, wherein each time delay in said time delay line is configured so that a time delay between arrayed antennas corresponds to a gain switching frequency.

5. The phased array antenna of claim 1 wherein said phase difference between the arrayed antennas is adjustable by changing a gain switching frequency.

* * * * *